US006099261A

United States Patent [19]

Worden

[11] Patent Number: 6,099,261

[45] Date of Patent: Aug. 8, 2000

[54] ROLLER VANE STAGE FOR A FUEL PUMP

[76] Inventor: Gary Worden, 12495 Church St., Birch Run, Mich. 48415-8759

[21] Appl. No.: 09/093,359

[22] Filed: Jun. 8, 1998

[51] Int. Cl.[7] ..... F04B 23/10

[52] U.S. Cl. ..... 417/204; 418/150

[58] Field of Search ..... 417/204, 199.1; 418/225, 150, 182

[56] References Cited

U.S. PATENT DOCUMENTS

| | | | |
|---|---|---|---|
| Re. 25,973 | 3/1966 | Cook | 417/204 |
| 475,301 | 6/1892 | Crowell | 418/150 X |
| 1,854,318 | 4/1932 | Terry | 418/182 X |
| 2,776,625 | 1/1957 | Cook et al. . | |
| 3,025,802 | 3/1962 | Browne . | |
| 3,072,067 | 1/1963 | Beller . | |
| 3,119,345 | 1/1964 | Cook . | |
| 3,359,913 | 12/1967 | Halsey . | |
| 3,373,693 | 3/1968 | McKittrick . | |
| 3,381,622 | 5/1968 | Wilcox . | |
| 3,734,654 | 5/1973 | Burenga et al. . | |
| 3,806,287 | 4/1974 | Sadler et al. . | |
| 4,354,809 | 10/1982 | Sundberg | 418/268 |
| 4,362,480 | 12/1982 | Suzuki et al. . | |
| 4,538,977 | 9/1985 | Ruhl et al. | 418/150 |
| 4,619,588 | 10/1986 | Moore, III | 418/182 X |
| 5,378,111 | 1/1995 | Christopher . | |
| 5,580,213 | 12/1996 | Woodward et al. . | |
| 5,601,422 | 2/1997 | Treiber et al. . | |

OTHER PUBLICATIONS

*V. Fuel Pumps*, (Copyright 1995 Bob Fruedenberger, Portions copyright 1995–1996 Automotive Information Center) (4 pages).

*Primary Examiner*—Charles G. Freay
*Assistant Examiner*—David J. Torrente
*Attorney, Agent, or Firm*—Wood, Herron & Evans, L.L.P.

[57] ABSTRACT

A roller vane stage (10) for a fuel pump (80) includes an inlet plate (12), an outlet plate (14), and a spacer (16) held therebetween, the spacer having an eccentric inner surface (20) defining a rotor space (18) therein. The roller vane stage (10) further includes a rotor (30) mounted for rotation within the rotor space (18) and the rotor has a plurality of lobes (40), wherein each lobe contains an associated roller (42). Driver slots (44) located in the rotor (30) have a depth less than the thickness (h) of the rotor. Center outlet port (26) in the outlet plate (14) is shaped such that a lobe (40) and its respective roller (42) remains in fluid communication with the center outlet port almost until the lobe begins to communicate with inlet ports (22, 24) in the inlet plate (12). The diameter of the roller (D) and the radius (R) of the rotor (30) are selected such that the radius of the rotor is not less than one half the difference between the rotor radius and the largest radius of the eccentric surface (20).

65 Claims, 6 Drawing Sheets

ROLLER VANE STAGE FOR A FUEL PUMP

BACKGROUND OF THE INVENTION

I. Field of the Invention

The present invention relates to fuel pumps and, more particularly, to a high pressure roller vane stage of a motor vehicle fuel pump.

II. Description of Prior Art

An automobile generally will have an engine which derives its power from the internal combustion of fuel, such as gasoline. That same automobile will also have a tank in which fuel that is to be consumed by the engine is stored. The fuel stored in the tank is transferred to the engine by means of a fuel delivery system which commonly includes a fuel pump located in or around the tank and a fuel line leading from the fuel pump to the engine. One conventional fuel pump design uses an electric motor to drive to a high pressure roller vane stage to produce the necessary pumping action.

In such roller vane stages, low-pressure fuel from the tank is pulled into the roller vane stage through one or more inlet ports, and exhausted under high-pressure out one or more outlet ports into the fuel line. One particular roller vane stage includes a disk shaped inlet plate carrying the inlet port(s), a disk-shaped outlet plate carrying the outlet port(s) and a spacer position therebetween. The spacer has a central aperture or opening therethrough with an eccentric inner surface which defines a rotor space. A circular rotor element is rotatably mounted in the rotor space for rotation about the centroid or axis of the rotor. The rotor rotates within the spacer aperture so as to cooperate with the eccentric surface to pull fuel into the rotor space through the inlet port(s) in the inlet plate and to exhaust same out of the outlet port(s) in the outlet plate.

There are generally two different pumping actions taking place in such a roller vane stage design. In particular, the rotor has a plurality of lobes located circumferentially about its periphery such that each lobe opens radially outwardly toward the eccentric inner surface. A roller is associated with and movable within each lobe. The outer periphery and thus the lobe openings of the rotor pass closer to a smaller radius section of the eccentric surface and further from a larger radius section. The rotor spins to thereby produce pumping action. Consequently, as the rotor rotates about its axis within the rotor space, a respective lobe passes along changing radius sections of the eccentric inner surface of the spacer such that fuel is sucked into the lobe from a first or central inlet port as the lobe-roller combination rotates from a smaller radius section of the eccentric surface to a larger radius section, and fuel is exhausted therefrom out of a first or central outlet port as the roller is forced back into the lobe as the lobe-roller combination rotates from the larger radius section to the smaller radius section. Additionally or alternatively, a void in an area defined adjacent a segment of the rotor outer periphery located between two successive lobes increases in size as the rotor passes from the smaller radius section of the eccentric surface to the larger radius section to thereby suck fuel into the void through a second or outer inlet port. Similarly, the void shrinks as the rotor segment passes from the larger radius section to the smaller radius section to thereby exhaust the fuel out of a second or outer outlet port. Successive rotation of the lobes and the outer periphery provides for a continuous conversion of low-pressure fuel coming from the tank to high-pressure fuel supplied to the engine.

To rotate the rotor element, driver slots are usually punched or otherwise formed completely through the rotor element to either side of the rotational axis thereof. An electric motor is provided with driver tangs that drivingly engage the driver slots to spin the rotor upon actuation of the motor.

Fuel pumps equipped with these high pressure roller vane stages suffer from various problems such as high vibration, excessive noise, undesirable pressure pulse, and fluid cavitation. It is believed that the excessive noise and vibration cause many consumers to register complaints with automotive service departments. As the problems are believed to originate from the roller vane stage design itself, there is no readily available repair the service department can offer. Recognizing that the roller vane stage design itself may be the source of the problems, the service department may refused to replace the fuel pump. Even if the service department replaces the fuel pump, this action may not solve the problems, and depending on the condition of the replacement fuel pump, may accentuate the noise and vibration problems. In addition, fuel pumps based upon such roller vane stages also suffer from undesirable pressure loss and excessive fuel heating. It has been suggested that increasing the rotation speed of the rotor, or providing a larger pump stage, might relieve some of these problems. However, such remedial measures may increase the electrical demands on the motor and generate increased noise and vibration of the fuel delivery system. Consequently, such remedial measures are believed to be unacceptable solutions, and other more effective solutions are desired.

SUMMARY OF THE INVENTION

The present invention provides a roller vane stage for a fuel pump, such as for use in motor vehicles, which overcomes the above-mentioned drawbacks. In accordance with one aspect of the present invention, I have come to believe that the open driver slots in the rotor provide a source of pressure loss between the inlet and outlet sides of the roller vane stage in that fuel may leak through the rotor along the motor driver tangs. To this end, and in accordance with this aspect of the invention, I overcome this problem by closing off one end of the driver slots such that there is no through-path for fuel along the motor driver tangs. More particularly, where the rotor has a predetermined thickness, ends of the driver slots have a depth less than the thickness of the rotor such that the driver slots do not extend completely through the rotor. As a consequence, I believe that my rotor can rotate at relatively lower speeds than prior art devices, yet can develop comparable fuel flow and pressures thereby reducing noise, vibration and the electricity demand of the motor.

In accordance with a further aspect of the invention, I have come to believe that some of the problems of the prior art devices are caused by the movement of the roller within the lobe during rotation of the rotor. In one instance, the roller, which typically has a circular cross-section, may rotate or spin about its axis within the lobe as the rotor rotates. Moreover, the roller may tend to spin in different directions depending upon its location along the spacer eccentric inner surface. For example, when the roller is in rolling engagement with the eccentric inner surface, the roller will spin in a clockwise direction where the rotor rotates counter-clockwise. When not in rolling engagement, however, the roller may stop spinning and possibly begin spinning in the opposite direction depending somewhat on the local fluid dynamics. Additionally, the roller may move radially within the lobe when not being forced by fluid pressure against the eccentric surface of the spacer. Such uncontrolled or erratic movements of the roller within the lobe may cause several undesirable conditions such as the generation of heat, noise, and vibration.

I have discovered that such uncontrolled and erratic movements of the roller may be overcome, at least in part, by constraining the roller within the lobe. In particular, I have found that the central outlet port of prior roller vane stages was configured such that a roller that was ceasing fluid communication with the central outlet port still had space within its respective lobe to move radially unconstrained and away from the inner surface of the space. Because the roller was no longer in communication with the central outlet port, fluid pressure was not available to force the roller against the eccentric surface. Indeed, it is believed that the roller would sweep part way between the pumping aspect of the eccentric surface and the suction aspect with little or no restriction on the roller's motion within its respective lobe, such that it could stall or be caused to spin in a direction opposite to that which is desired such that when it is again pressed out by fluid motion against the eccentric surface, it will be forced to change direction resulting in noise, heat and the like. To overcome such problems, and in accordance with the principles of the present invention, the central outlet port has a portion shaped such that fuel pressure is applied to a roller leaving the pumping section until that roller fills the lobe, minimizing the unrestrained movement of the roller. As such, the roller is continually constrained within its respective lobe up against the eccentric surface of the spacer. This aspect of the invention is believed to reduce or eliminate the reciprocating radial motion and the uncontrolled motion of the roller within the lobe, and thereby reducing the generation of heat, noise, and vibration.

In accordance with another aspect of this invention, I have come to believe that the rollers of prior art devices may experience a pinching effect between the rotor lobe and the eccentric surface of the spacer. It is believed that such a pinching effect increases wear of the rotor, the roller and the eccentric surface and increases the torque demand of the electric motor and thus its electrical demand. In this regard, in prior devices, there was at least one area of rotation of the rotor across the larger radius section of the eccentric surface where more than half of the roller could project out of the lobe beyond the periphery of the rotor. When more than half of the roller projects out of the lobe beyond the periphery of the rotor, the roller may experience a pinching effect between the junction of the lobe opening and the periphery of the rotor and the eccentric surface. I have resolved such problems by appropriate dimensioning of the roller and/or rotor such that the diameter of each roller, where the roller is circular in cross-section, and the radius of the rotor are selected such that the difference between the radius of the largest radius arc of the eccentric surface and the radius of the rotor is not greater than one half the diameter of the roller. As a consequence, as the rotor passes across the largest radius of the eccentric surface, the roller may not project out of the lobe by an amount that exceeds one-half of its diameter. Accordingly, the pinching effect is reduced or eliminated.

By virtue of the foregoing, there is thus provided a roller vane stage which reduces noise, vibration, fuel heating, cavitation, and fuel pressure pulsation problems associated with the prior art roller vane stages for fuel pumps. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description of the embodiments given below, serve to explain the principles of the invention.

DETAILED DESCRIPTION OF THE DRAWINGS

Figure 1:
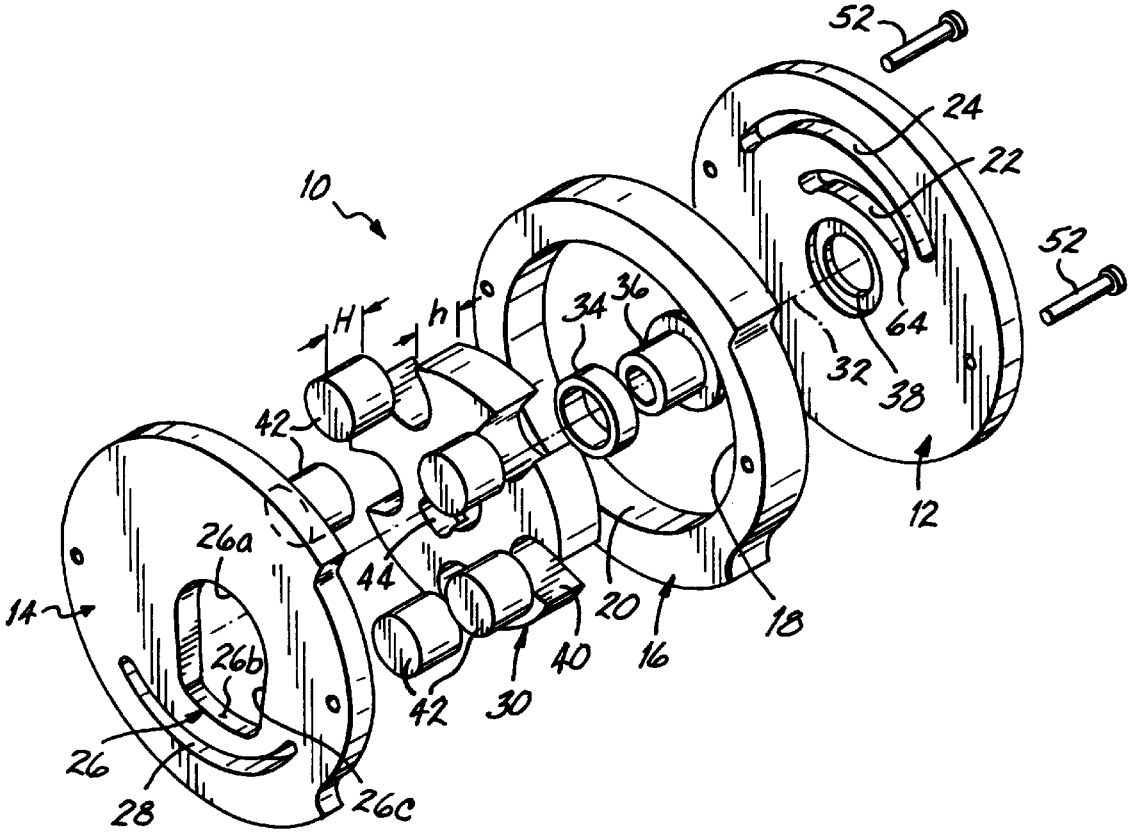
FIG. 1 is an exploded, perspective view of a roller vane stage in accordance with the principles of the present invention.
Figure 2:
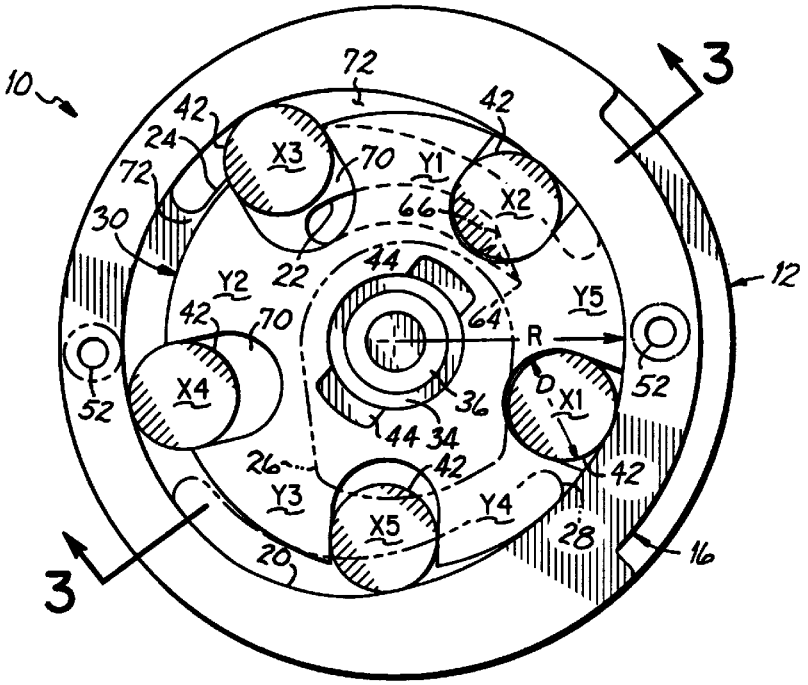
FIG. 2 is an outlet side plan view of the roller vane stage of FIG. 1 with the outlet plate removed for clarity and the outlet ports shown in phantom.

With reference to FIGS. 1 and 2, there is shown a high pressure roller vane stage 10 of a fuel pump assembly in accordance with the principles of the present invention. Roller vane stage 10 includes a disk-shaped inlet plate 12, a disk-shaped outlet plate 14, and a spacer 16 position therebetween. The spacer 16 has a rotor space opening or aperture 18 therethrough which is bounded by an eccentric inner surface 20. Inlet plate 12 includes a first or central inlet port 22 and a second or outer inlet port 24 both of which communicate through the inlet plate to rotor space opening 18. The inlet ports 22 and 24 are generally arcuate in shape with outer inlet port 24 having a greater circumferential length than central inlet port 22 and being spaced radially outwardly of port 22. Outlet plate 14 similarly includes a first or central outlet port 26 and a second or outer outlet port 28 both of which communicate through the outlet plate into rotor space 18. Central outlet port 26 has a periphery defined by a U-shaped section 26*a* and an arcuate section 26*b* intersecting the otherwise open end of the U-shape section 26*a*. Outer outlet port 28 has a greater circumferential length than arcuate section 26*b* of central outlet port 26 and is spaced radially outwardly of port 26.

The roller vane stage 10 further includes a rotor 30 mounted for rotation about centroid or axis 32 of the rotor. The rotor 30 is fitted over sleeve 34 mounted onto bearing 36. Bearing 36 is fixably mounted in throughhole 38 in inlet plate 12. The rotor 30 includes five, generally U-shaped, lobes 40 spaced circumferentially and equidistantly about the rotor and opening radially outwardly towards the eccentric inner surface 20. Associated with and movable within each lobe 40 is a roller 42. Rollers 42 are generally cylindrical in shape and may be either solid or hollow. However, it has been found to be advantageous if the rollers 42 are solid.

Figure 3:
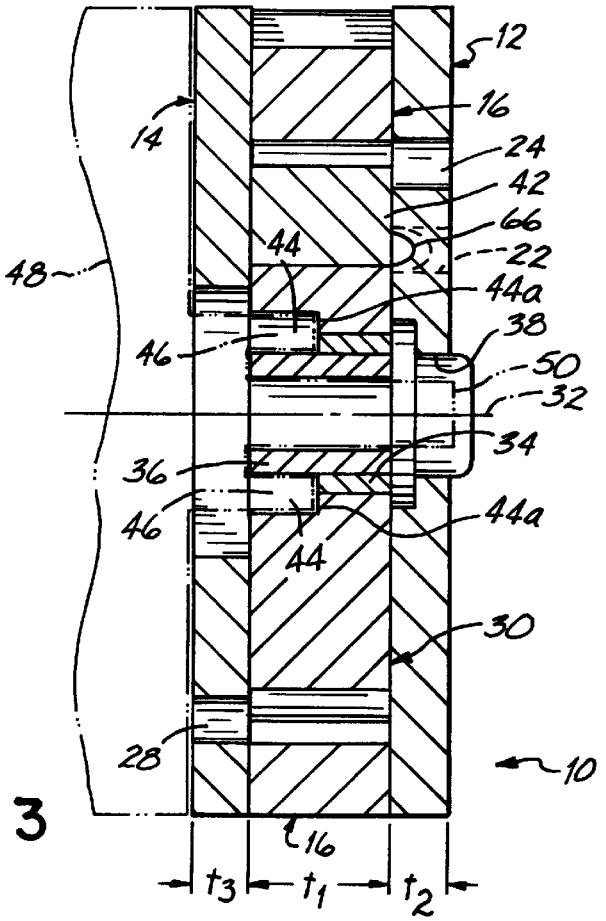
FIG. 3 is a cross-sectional view along lines 3—3 of FIG. 2 of the roller vane stage of FIG. 1 coupled to a motor.

With further reference to FIG. 3, rotor 30 further includes one or more driver slots 44 adapted to be engaged by one or more driver tangs 46 of a fuel pump motor 48 (dashed outline) so as to impart rotational motion to the rotor. The driver slots 44 are positioned radially outward and adjacent to the outer periphery of sleeve 34. When two or more driver slots 44 are used in rotor 30, the driver slots 44 should be spaced equidistantly about the periphery of the sleeve 34 to ensure balanced engagement of the driver tangs 46 therein. While two driver slots 44 are shown in accompanying figures, five driver slots may be advantageously employed to better balance the rotor 30 during rotation. Further, the rotor vane stage 10 in conjunction with bearing 36 is aligned with and mounted on armature 50 of the fuel pump motor 48. The inlet plate 12, outlet plate 14, and the spacer 16 are fixedly held together in sandwich relationship by fasteners 52 such as pins, screws, rivets or the like.

As can be seen with reference to FIG. 2, inlet ports 22 and 24 lie radially outwardly from U-shaped section 26*a* in a first direction away from axis 32 with arcuate section 26*b* and second outlet port 28 being radially outwardly of axis 32 in the opposite direction. The positioning of ports 22, 24, 26, and 28 is such that ports 22 and 26 comprises one cooperating pair of ports, i.e., fuel entering through inlet port 22 will be primarily exhausted through outlet port 26 and ports 24 and 28 comprise another cooperating pair of ports, i.e., fuel entering through inlet port 24 will be primarily exhausted through outlet port 28.

Rotor 30 has a thickness h and spacer 16 has a thickness t1. Additionally, inlet plate 12 and outlet plate 14 have thicknesses t2 and t3, respectively. Advantageously, thickness t1 is 6.054 mm (0.2383 in) and thicknesses for both t2 and t3 is 2.49 mm (0.0980 in). Rotor 30 has a radius R. Advantageously, radius R of rotor 30 is 12.004 mm (0.4726 in). Each roller 42 has a thickness H which is essentially equivalent to the thickness h of rotor 30. Rotor thickness h and roller thickness H are approximately equal to but are not greater than thickness t1 of spacer 16. Advantageously, rotor thickness h is 6.026 mm (0.2372 in) and roller thickness H is 6.016 mm (0.2368 in). The rollers have a diameter D which is substantially the same as the width W of lobe 40. Advantageously, the diameter D is 5.29 mm (0.2083 in) and lobe width W is 5.68 mm (0.2236 in). The thickness H of a roller 42 can be as small as one diameter D of the roller, but a roller thickness of at least twice the diameter of the roller has been found to be more advantageous. It is believed that the increased roller thickness H makes the roller 42 more stable thereby reducing the tendency of the roller to chatter as it moves in and out of its respective lobe 40.

Figure 4:
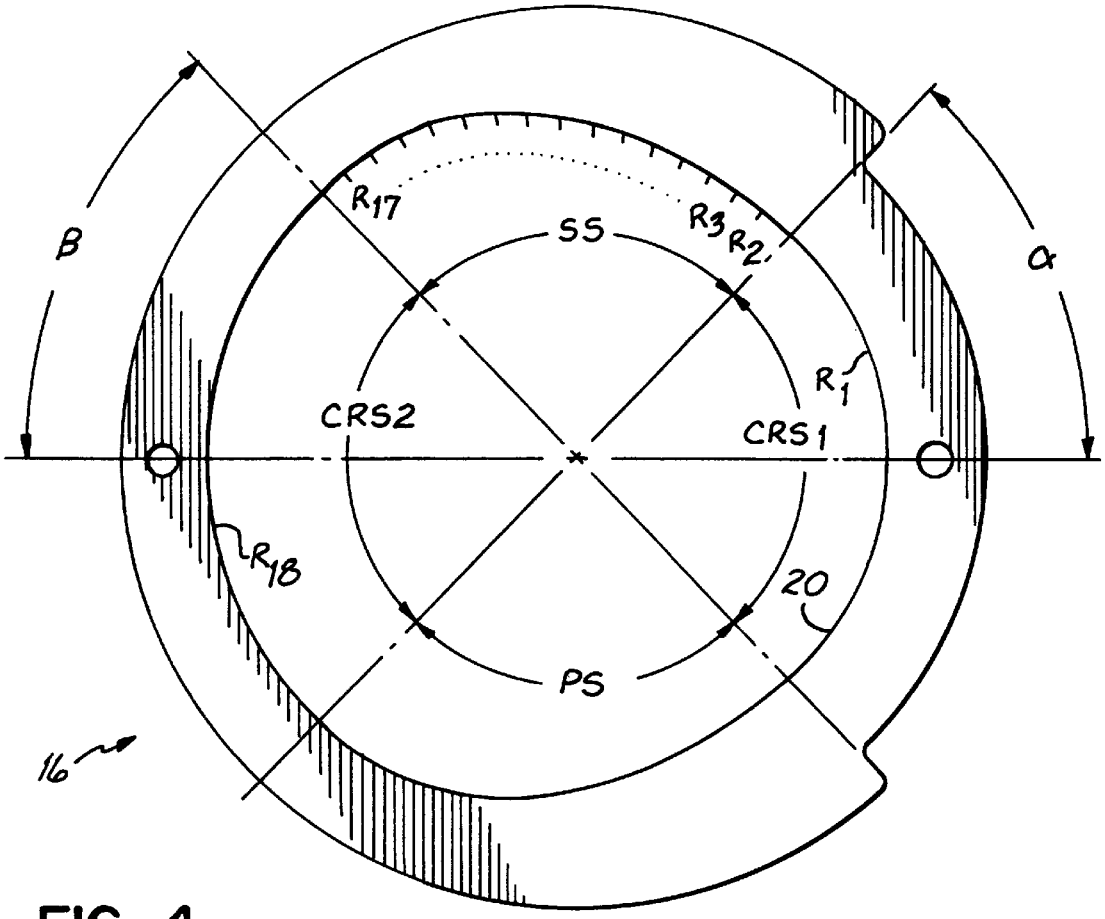
FIG. 4 is a top plan view of the spacer of the roller vane stage of FIG. 1.

The proper geometric contour of the eccentric inner surface 20 of spacer 16 is advantageous for the efficient operation of the roller vane stage 10. The eccentricity of eccentric inner surface 20 is defined with respect to centroid or axis 32 about which rotor 30 rotates. Referring specifically to FIG. 4, the eccentric inner surface 20 is defined by a plurality of interconnected circular arcs, where each arc has a radius $R_i$. It is believed that the radiuses $R_i$ as given in Table 1 used in conjunction with roller vane stage components with dimensions as given above, define an eccentric inner with sought after advantages such as high pumping efficiency and reduced noise and vibration. As shown in FIG. 4, the eccentric inner surface 20 includes two constant radius arcs R1 and R18 oppositely disposed of each other. The radius of arc R1 is the smallest radius of all the other arcs describing the inner surface 20. Arc R1 defines a constant radius sweep CRS1 which extends through angle $2\alpha$. Preferably, $\alpha$ is in the range between 42° and 50°. More preferably $\alpha$ is in the range between 45° and 47°. Most preferably $\alpha$ is approximately 46.43°. In contrast, the radius of arc R18 is the largest radius of all the other arcs describing the inner surface 20. Arc R18 defines a constant radius sweep CRS2 which extends through angle $2\beta$. Preferably, $\beta$ is in the range between 42° and 50°. More preferably $\beta$ is in the range between 45° and 47°. Most preferably $\beta$ is approximately 46.29°. As can be appreciated, the radius R of rotor 30 must be less than the radius of arc R1. However, pumping efficiency of the roller vane stage 10 is thought to be improved when the radius R of rotor 30 closely approximates the radius of arc R1.

TABLE 1

Radiuses of Eccentric Inner Surface 20 of Spacer 16

| $R_i$ | Radius (mm) |
|---|---|
| R1 | 12.0530 |
| R2 | 12.0534 |
| R3 | 12.0603 |
| R4 | 12.0889 |
| R5 | 12.1561 |
| R6 | 12.2726 |
| R7 | 12.4400 |
| R8 | 12.6491 |
| R9 | 12.8872 |
| R10 | 13.1380 |
| R11 | 13.3869 |
| R12 | 13.6208 |
| R13 | 13.8274 |
| R14 | 13.9990 |
| R15 | 14.1301 |
| R16 | 14.2201 |
| R17 | 14.2732 |
| R18 | 14.3029 |

Arcs R1 and R18 are interconnected by a plurality of differing radius circular arcs R2–R17. The differing radius arcs R2–R17 define either a suction sweep SS or a pumping sweep PS. With specific reference to FIG. 4 and assuming a counterclockwise rotation, the suction sweep SS is defined by a sweep along the inner surface 20 starting from the smallest radius R1, through the monotonically increasing radiuses R2–R17 and ending at the largest radius arc R18. Likewise, the pumping sweep PS is defined by a sweep along the inner surface 20 starting from the largest radius R18, through the monotonically decreasing radiuses R17–R2 and ending at the smallest radius arc R1. For example, the roller designated X3, as illustrated in FIG. 2, is advancing along the suction sweep SS and the roller designated X5 is advancing along the pumping sweep PS.

It was found to be advantageous to the operation of the roller vane stage 10 if the radius of arc R18 and the radius R of the rotor 30 are chosen such that the difference between the two dimensions is no greater than one-half the diameter D of the roller 42. It is believed that if radiuses R18 and R of the rotor 30 are so chosen, the roller 30 can traverse around the eccentric inner surface 20 without experiencing an undesirable pinching effect between the lobe 40 and the eccentric inner surface.

It is believed that a rotor having open driver slots provides a source of pressure loss between the inlet and outlet sides of a roller vane stage in that fuel may leak through the rotor along motor driver tangs imparting rotational motion to the rotor. To this end, and in accordance with this aspect of the invention, the ends 44*a* of driver slots 44 are closed off such that there is no through-path for fuel along the motor driver tangs 46. More particularly, driver slots 44 have a depth less than thickness h of rotor 30 such that the driver slots terminate at ends 44*a* and do not extend completely through the rotor. In addition, bearing 36 is closed or capped such that armature 50 of motor 48 does not extend completely through the bearing. It is believed that use of a closed or capped bearing 36 eliminates pressure loss between the high pressure section of the stage 10 to the low pressure section via armature 50 through the bearing. Likewise, it is believed that closed driver slots 44 reduce or eliminate a source of pressure loss between the high pressure section of the stage 10 to the low pressure section. Accordingly, rotor 30 of the present invention rotates at relatively lower speeds than prior art devices, yet develops comparable fuel flow and pressures thereby reducing noise and vibration.

During operation of the roller vane stage 10, roller 42, which typically has a circular cross-section, may rotate or spin about its axis within its respective lobe 40 as the rotor 30 rotates. For instance, when the rotor 30 spins in a counterclockwise direction and rotor 42 is in rolling engagement with eccentric inner surface 20, the roller will spin in a clockwise direction. However, the roller 42 may spin about its axis in different directions when rolling engagement with the eccentric inner surface 20 is not maintained. It is believed that prior art designs experienced changes in roller spin direction especially as the roller ceased fluid communication with the center outlet port and traversed towards the inlet ports. More specifically, in prior art designs a roller ceasing fluid communication with the central outlet port would be forced away from the eccentric inner surface by high pressure fuel leaking from the outer outlet port along the small gap between the rotor and the eccentric inner surface. As such, the spin of the roller may slow, stop and possibly change direction as a result of the movement of the high pressure fuel leaking past the roller. Moreover, as the roller begins fluid communication with the outer inlet port the roller may again change direction as the incoming fuel encourages a clockwise rotation of the roller. In addition to changes in spin direction, roller 42 may move radially within the lobe 40 when not being forced by fluid pressure against the eccentric inner surface 20 of the spacer 16. As can be expected such uncontrolled or erratic movements of roller 42 within lobe 40 may cause several undesirable conditions such as the generation of heat, noise, and vibration. It is believed that such uncontrolled and erratic movements of roller 42 may be overcome, at least in part, by constraining the roller within its respective lobe 40. To this end, the central outlet port 26 is configured such that a roller 42 leaving the pumping section of eccentric inner surface 20 is continually constrained within its respective lobe 42 up against the eccentric inner surface of spacer 16.

This aspect of the invention is further explained with reference to FIGS. 5*a*–5*c*. As shown in FIG. 5*c* eccentric inner surface 20 has a constant radius arc with radius R1. For purposes of explanation, a reference line RL included which starts at axis 32 of rotor 40 and extends radially outwardly through point 56 which bisects the constant radius arc.

Figure 5A:
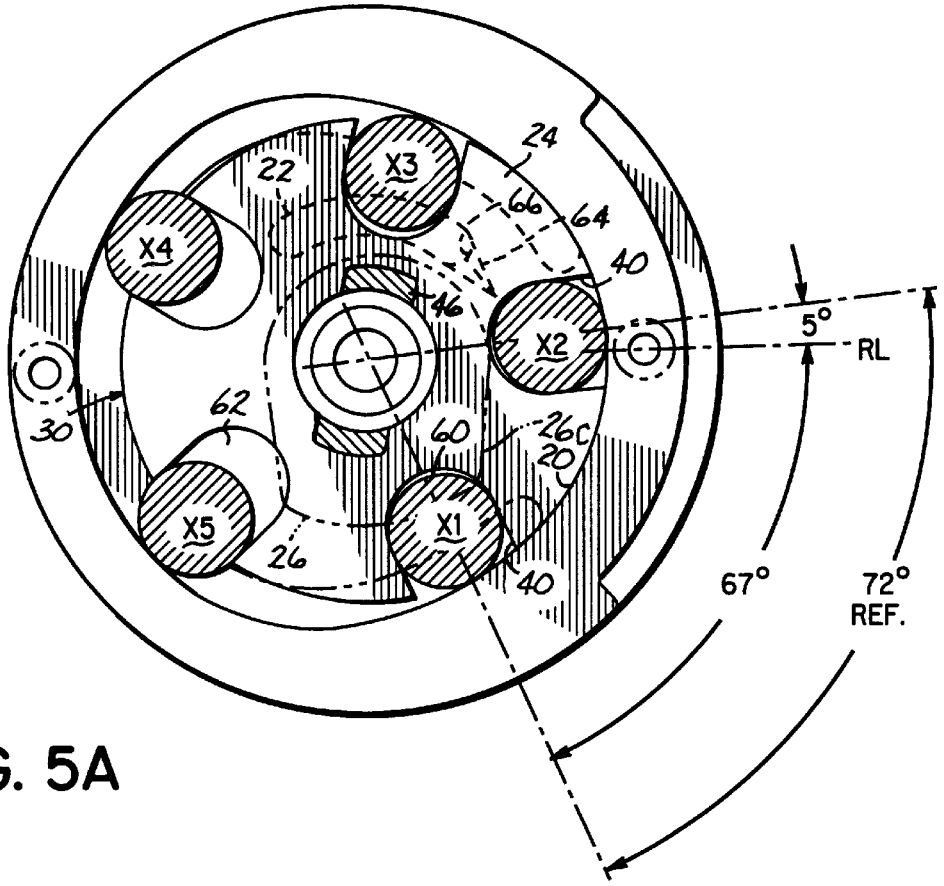
FIGS. 5*a*–5*c* are schematic representations of the roller vane stage of FIG. 1 at different degrees of rotation for the purpose of explaining the principles of operation thereof.

With reference to FIG. 5*a* and assuming counterclockwise rotation of rotor 30, lobe 40 containing roller X1 is shown rotating through the decreasing radius section along and in rolling engagement with the eccentric inner surface 20 of spacer 16. As shown in FIG. 5*a*, void 60 between roller X1 and the closed end of lobe 40 has nearly vanished as roller X1 is pushed back into the lobe by the decreasing radius along the eccentric inner surface 20. As such, the fuel that once filled void 60 is almost completely exhausted through central outlet port 26 where roller X1 is about 67 degrees clockwise from the reference line. Also shown in FIG. 5*a* roller X5 is just beginning to communicate with the central outlet port 26, and thereby exhaust the fuel contained in void 62 behind roller X5.

Figure 5B:
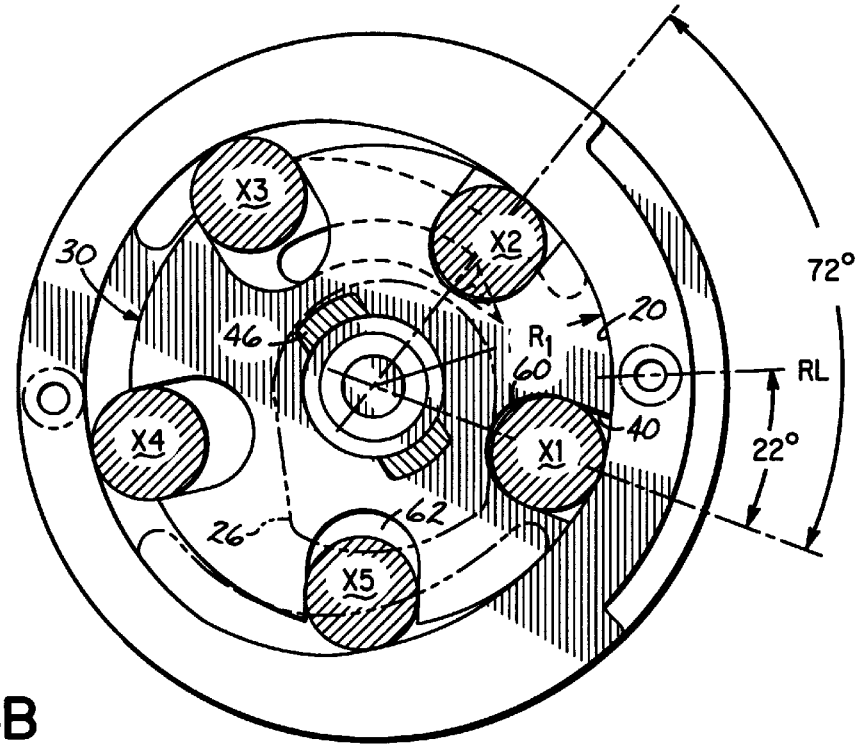
Figure 5C:
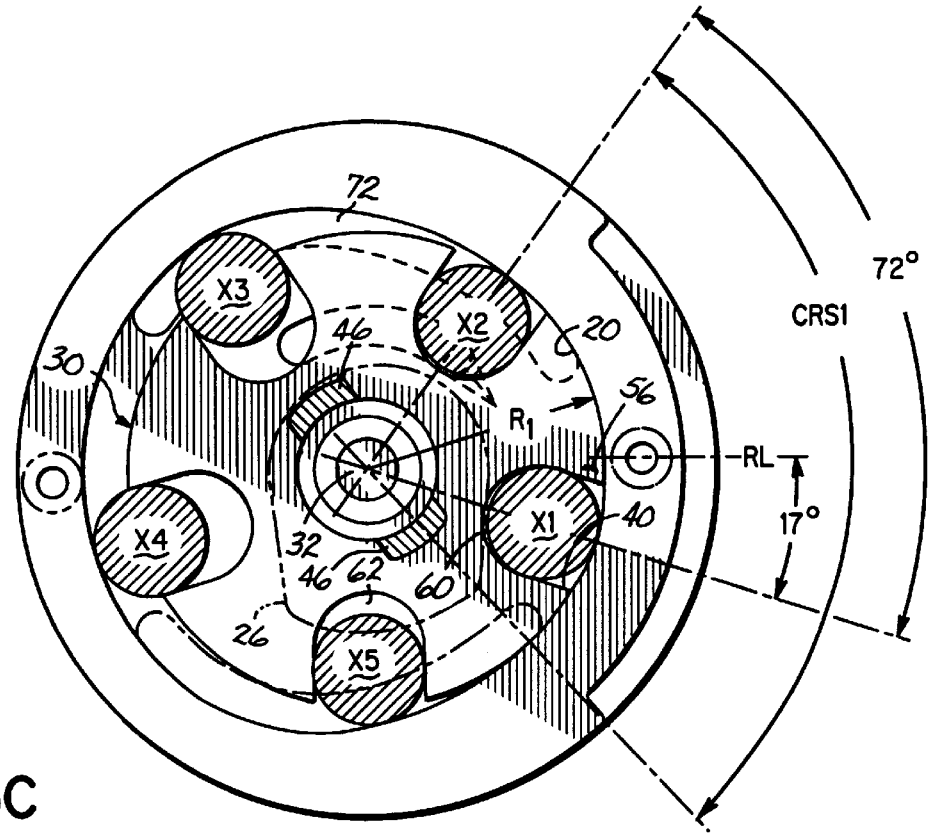

With reference to FIG. 5*b*, roller X1, now rotated to 22 degrees from the reference line, is in the constant radius section of eccentric inner surface 20. As such the void 60 associated with roller X1 is at its minimum volume capacity. At this point of the rotation of rotor 30, roller X5 continues to 10 pump fuel contained in its void 62 through central outlet port 26. A portion of the fuel exiting void 62 exerts a pressure on roller X1 because X1 is still in fluid communication with central outlet port 26. As a result the fuel pressure pushes roller X1 against the eccentric inner surface 20, thereby maintaining rolling engagement of the roller with the eccentric inner surface. As a result uncontrolled or erratic movements that roller X1 may otherwise experience are reduced or eliminated.

With reference to FIG. 5*c*, roller X1 and its respective lobe 40, now rotated to 17 degrees from the reference line, intersect the reference line. At this stage roller X1 is almost no longer in fluid communication with central outlet port 26. After additional rotation, the fuel exiting void 62 behind roller X5 will no longer supply pressure roller X1. In prior art designs the roller had already ceased fluid communication with the central outlet port before intersecting the reference line. In accordance with the principles of the present invention, leg portion 26*c* of U-shaped section 26*a* partially defining central outlet port 26 is positioned radially outward such that lobe 40 containing roller X1 is still in fluid communication with the central outlet port as that lobe intersects the reference line. Consequently, any radial movement which roller X1 may experience is significantly restrained by the remaining fuel in void 60 as roller X1 sweeps through this constant radius section along the eccentric inner surface 20.

The movement of a roller 42 within its respective lobe 40 can also be problematic upon contact with inlet ports 22 and 24. It is believed that the radial movement of a roller 42 can be controlled, in part, by simultaneously introducing fuel through inlet ports 22 and 24 into the roller's respective lobe 40. One particular configuration to achieve this simultaneous introduction of fuel, as shown in FIG. 5*a*, provides a tapered extension 64 attached ahead of the trailing edge 66 of central inlet port 22. The depth of tapered extension 64 gradually increases from its tip until its depth equals thickness t2 of inlet plate 12 at the trailing edge 66 of the central inlet port 22. As such, the tapered extension 64 is in fluid communication with central inlet port 22 and is sized such that lobe 40 carrying roller X2 contacts almost simultaneously both outer inlet port 24 and tapered extension 64. Thus, when lobe 40 is positioned approximately 5 degrees above the 0 degree reference line, the lobe will be in nearly simultaneous fluid communication with inlet ports 22 and 24. The above description of the geometry and position of lobe 40 and inlet ports 22 and 24 is based on a rotor 30 rotation speed of approximately 2400 RPM. It is believed that as the RPM of the rotor 30 increase, more fuel flow is achieved. To accommodate this extra fuel flow, leg portion 26*c* of central outlet port 26 and tapered extension 64 may need to be extended.

During operation, the electric motor 48 spins driver tangs 46 which impart rotational motion to the rotor 30. The rotational motion of rotor 30 produces two different pumping actions within the roller vane stage 10. In particular and with reference to FIG. 2 one pumping action occurs between cooperating pairs of ports 22 and 26. To this end and assuming counterclockwise rotation of rotor 30, roller X2 has entered the suction sweep section and the associated lobe 40 is in fluid communication with inlet ports 22 and 24. As stated above, the suction sweep section means that the eccentric inner surface 20 of spacer 16 has increasing radius arcs from R2 through R17. It is believed that during rotation centripetal force acts to move roller 42 radially out of its respective lobe 40 as illustrated by roller X3 in FIG. 2. Consequently, a void 70 forms behind roller 42 and lobe 40 such that fuel is drawn into the void by suction through central inlet port 22. As the lobe sweeps by the maximum radius arc R18 the void 70 between roller 42 and lobe 40 is at a maximum as illustrated by roller X4 in FIG. 2. As a roller 42 rotates through the pumping sweep section the radius of successive arcs decreases from R17 to R2 such that the roller is forced to radially retreat back into the its respective lobe 40. As illustrated by roller X5, the fuel is forced out of the void between the roller X5 and its respective lobe. The fuel is thereby exhausted through the central outlet port 26 and sent under pressure via fuel lines to the engine. This suction and pumping action is a continuous process for each roller-lobe combination as long as sufficient rotational motion is imparted to the rotor 30.

A second pumping action is generated by the outer periphery of the rotor by cooperating pairs of ports 24 and 28. Again, and with reference to FIG. 2 and assuming counterclockwise rotation, outer periphery section Y1 of rotor 30 has entered the suction sweep section creating a three dimensional void 72 between the section Y1 and the eccentric surface 20. Void 72 is in fluid communication with inlet port 24 such that fuel from the tank is sucked into the void as it expands. At outer periphery section Y2, void 72 now defined by eccentric surface 20, rollers X3 and X4 and the outer periphery of the rotor 30 at section Y2 is filled with fuel. As outer periphery section Y3 begins to enter the pumping sweep section, the volume of void 72 diminishes such that the fuel is exhausted through outer outlet port 28 and sent under pressure via fuel lines to the engine. As the rotation continues, void 72 is substantially eliminated at outer periphery sections Y4 and Y5.

Figure 6:
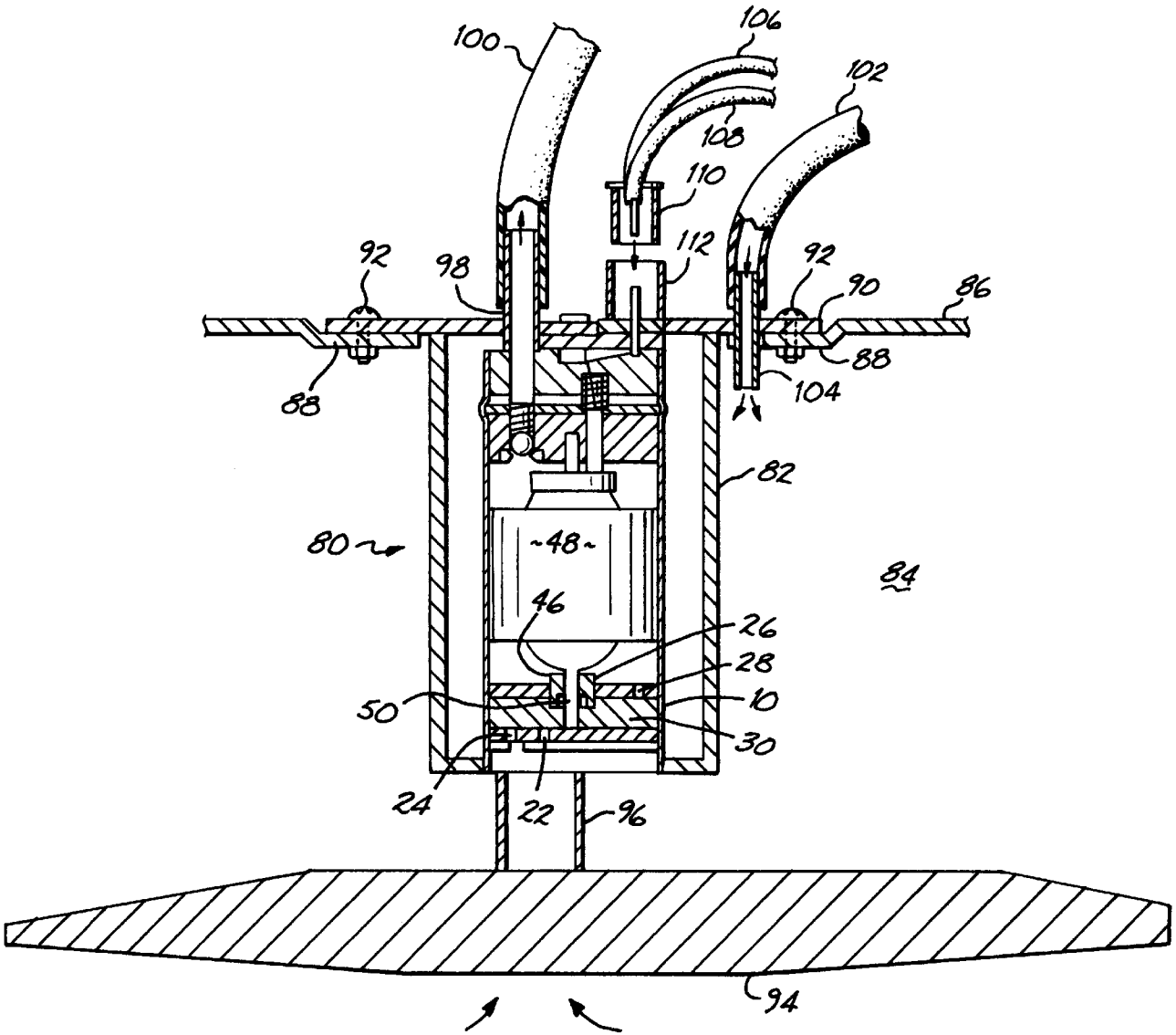
FIG. 6 is a cross-sectional view of a fuel pump assembly incorporating the roller vane stage of FIG. 1 mounted on the interior of a fuel tank.

In use and with reference to FIG. 6, the roller vane stage 10 of the present invention is used in a fuel pump assembly 80 which is mounted in bucket 82 located in interior 84 of fuel tank 86. Fuel tank 86 includes a recessed annular lip 88 which is size to receive mounting cover 90 to which fuel pump assembly 80 is attached. Mounting cover 90 is secured to lip 88 by screws 92 and has a thickness such that the mounting cover is flush with the exterior surface of fuel tank 86. Fuel tank 86, which is mounted to an automobile (not shown), contains fuel, such as gasoline, for use in the internal combustion engine which powers the automobile.

More specifically, electric motor 48 spins driver tangs 46 which in turn rotate rotor 30 about armature 50. As explained above, the rotation creates two pumping actions such that fuel is sucked in through fuel filter 94, through inlet conduit 96, and through to inlet ports 22 and 24. The pumping actions exhaust pressurized fuel from outlet ports 26 and 28 which is directed over the sealed electric motor 48 for cooling and then out of the fuel pump assembly 80 by way of outlet conduit 98. A first fuel line 100 delivers the fuel to the engine for use in the combustion process as well as to cool the fuel injection system. Fuel not used in the combustion process is returned to the fuel tank via second fuel line 102 which is connected to return conduit 104. Electrical power is supplied to electric motor 48 via electric wires 106 and 108 which terminate in female connector 110. Female connector 110 connects to male connector 112 which is connected to electric motor 48.

While the present invention has been illustrated by a description of a preferred embodiment thereof, and while the embodiment has been described in considerable detail, it is not the intention of the applicant to restrict or in any way limit the scope of the appended claims to such detail. Additional advantages and modifications will readily appear to those skilled in the art. For example, roller 42 need not be cylindrical in shape, but could be some other suitable shape. For instance, the roller may have a diamond or elliptical shape. Thus, to accommodate a noncylindrical roller the roller lobe 40 would have to be shaped accordingly. As such, a noncylindrical roller would not have the freedom to spin or rotate within its respect lobe. The invention in its broader aspects is therefore not limited to the specific details, representative apparatus and method, or the illustrative example shown and described. Accordingly, departures may be made from such details without departing from the spirit or scope of applicant's general inventive concept.

What is claimed is:

1. A roller vane stage for a fuel pump comprising:

an inlet plate, an outlet plate, and a spacer positioned therebetween, said spacer having an eccentric inner surface defining a rotor space therein, said inlet plate having at least one inlet port therethrough communicating with said rotor space, and said outlet plate having at least one outlet port therethrough communicating with said rotor space; and a rotor mounted for rotation within said rotor space and having a plurality of lobes spaced circumferentially about said rotor and opening radially outwardly towards said eccentric inner surface, a roller associated with and movable within each said lobe, said rotor further having a driver slot adapted to be engaged by a driver tang of a motor of the fuel pump to rotate said rotor within said rotor space so as to pump fuel, said rotor having a predetermined thickness, said driver slot having a depth less than said rotor thickness such that said driver slot does not extend completely through said rotor.

2. The roller vane stage of claim 1 where said inlet plate has first and second inlet ports and said outlet plate has first and second outlet ports.

3. The roller vane stage of claim 2 where said second inlet port is spaced radially outwardly of said first inlet port and said second outlet port is spaced radially outwardly of said first outlet port.

4. The roller vane stage of claim 3 where said first and second inlet ports are arcuate in shape, said second outlet port is arcuate in shape, and said first outlet port is defined by a U-shaped section and an arcuate section intersecting the otherwise open end of said U-shaped section.

5. The roller vane stage of claim 4 where said first inlet port and said first outlet port are positioned to form a first pair of cooperating ports, and said second inlet port and said second outlet port are positioned to form a second pair of cooperating ports.

6. The roller vane stage of claim 5 where said first inlet port has a trailing edge and a tapered extension disposed ahead of said trailing edge.

7. The roller vane stage of claim 1 where said rotor has five lobes.

8. The roller vane stage of claim 7 where each said lobe is U-shaped and each roller is cylindrical and sized to fit within said U-shaped lobe.

9. The roller vane stage of claim 8 where each said roller is solid.

10. The roller vane stage of claim 9 where said roller has a thickness and a diameter such that said thickness of said roller is no less than said diameter of said roller.

11. The roller vane stage of claim 10 where said thickness of said roller is twice said diameter of said roller.

12. The roller vane stage of claim 1 where said rotor has two driver slots adapted to be engaged by pair of driver tangs of the fuel pump motor.

13. The roller vane stage of claim 1 where said eccentric inner surface is defined by a first circular arc having a radius and by a second circular arc having a radius, said second circular arc being oppositely disposed of said first circular arc, said first and second arcs being interconnected by a plurality of circular arcs of differing radii, said first arc radius being greater than said second arc radius and each of said radii of said plurality of circular arcs, said second arc radius being smaller than said first arc radius and each of said radii of said plurality of circular arcs.

14. The roller vane stage of claim 13 where each said roller has a diameter, said rotor also having a radius, the difference between said radius of said first arc and said radius of said rotor being no greater than one-half of said roller diameter.

15. The roller vane stage of claim 14 where said second circular arc of said eccentric inner surface is bisected by a reference line intersecting the axis of said rotor, and said outlet port is sized such that as said rotor rotates, one of said lobes will be in fluid communication with said outlet port until said one lobe becomes tangent to the reference line.

16. The roller vane stage of claim 1 where said eccentric inner surface has a circular arc bisected by a reference line intersecting the axis of said rotor, and said outlet port is sized such that as said rotor rotates, one of said lobes will be in fluid communication with said outlet port until said one lobe becomes tangent to the reference line.

17. The roller vane stage of claim 1, wherein said rotor is mounted on a bearing, said bearing having a cap such that an armature of said motor of said fuel pump cannot extend completely therethrough.

18. A roller vane stage for a fuel pump comprising:

an inlet plate, an outlet plate, and a spacer positioned therebetween, said spacer having an eccentric inner surface defining a rotor space therein, said inlet plate having at least one inlet port therethrough communicating with said rotor space, and said outlet plate having at least one outlet port therethrough communicating with said rotor space;

said eccentric inner surface being defined by a first circular arc having a radius and by a second circular arc having a radius, said second circular arc being oppositely disposed of said first circular arc, said first and second arcs being interconnected by a plurality of circular arcs of differing radii, said first arc radius being greater than said second arc radius and each of said radii of said plurality of circular arcs, said second arc radius being smaller than said first arc radius and each of said radii of said plurality of circular arcs; and a rotor within said rotor space and having a plurality of U-shaped lobes spaced circumferentially about said rotor and opening radially outwardly towards said eccentric inner surface, and a solid, cylindrical roller associated with and movable within each said U-shaped lobe, each said roller having a thickness and a diameter, said thickness of said roller is not less than said diameter of said roller, said rotor being rotatably mounted within said rotor space for rotation about an axis, said rotor also having a radius, the difference between said radius of said first arc and said radius of said rotor being no greater than one-half the diameter of said rollers.

19. The roller vane stage of claim 18 where said inlet plate has first and second inlet ports and said outlet plate has first and second outlet ports.

20. The roller vane stage of claim 19 where said second inlet port is spaced radially outwardly of said first inlet port and said second outlet port is spaced radially outwardly of said first outlet port.

21. The roller vane stage of claim 20 where said first and second inlet ports are arcuate in shape, said second outlet port is arcuate in shape, and said first outlet port is defined by a U-shaped section and an arcuate section intersecting the otherwise open end of said U-shaped section.

22. The roller vane stage of claim 21 where said first inlet port and said first outlet port are positioned to form a first pair of cooperating ports, and said second inlet port and said second outlet port are positioned to form a second pair of cooperating ports.

23. The roller vane stage of claim 22 where said first inlet port has a trailing edge and a tapered extension disposed ahead of said trailing edge.

24. The roller vane stage of claim 18 where said rotor has five lobes.

25. The roller vane stage of claim 18 where said thickness of said roller is twice said diameter of said roller.

26. The roller vane stage of claim 18 where said second circular arc of said eccentric inner surface is bisected by a reference line intersecting the axis of said rotor, and said outlet port is sized such that as said rotor rotates, one of said lobes will be in fluid communication with said outlet port until said one lobe becomes tangent to the reference line.

27. The roller vane stage of claim 18 where said first circular arc and said second circular arc are interconnected by 16 circular arcs, each of said 16 circular arcs having a radius no greater than said radius of said first circular arc and no less than said radius of said second circular arc, and each said radius of said 16 circular arcs being different.

28. The roller vane stage of claim 18, wherein said rotor is mounted on a bearing, said bearing having a cap such that an armature of a motor of said fuel pump cannot extend completely therethrough.

29. A roller vane stage for a fuel pump comprising:

an inlet plate, an outlet plate, and a spacer positioned therebetween, said spacer having an eccentric inner surface defining a rotor space therein, said inlet plate having at least one inlet port therethrough communicating with said rotor space, and said outlet plate having at least one outlet port therethrough communicating with said rotor space; and a rotor mounted for rotation about its axis within said rotor space and having a plurality of lobes spaced circumferentially about said rotor and opening radially outwardly towards said eccentric inner surface, and a roller associated with and movable within each said lobe;

said eccentric inner surface having a circular arc bisected by a reference line intersecting the axis of said rotor;

said outlet port being sized such that as said rotor rotates, one of said lobes will be in fluid communication with said outlet port until said one lobe becomes tangent to the reference line.

30. The roller vane stage of claim 29 where said inlet plate has first and second inlet ports and said outlet plate has first and second outlet ports.

31. The roller vane stage of claim 30 where said second inlet port is spaced radially outwardly of said first inlet port and said second outlet port is spaced radially outwardly of said first outlet port.

32. The roller vane stage of claim 31 where said first and second inlet ports are arcuate in shape, said second outlet port is arcuate in shape, and said first outlet port is defined by a U-shaped section and an arcuate section intersecting the otherwise open end of said U-shaped section.

33. The roller vane stage of claim 32 where said first inlet port and said first outlet port are positioned to form a first pair of cooperating ports, and said second inlet port and said second outlet port are positioned to form a second pair of cooperating ports.

34. The roller vane stage of claim 33 where said first inlet port has a trailing edge and a tapered extension disposed ahead of said trailing edge.

35. The roller vane stage of claim 29 where said rotor has five lobes.

36. The roller vane stage of claim 35 where each said lobe is U-shaped and each roller is cylindrical and sized to fit within said U-shaped lobe.

37. The roller vane stage of claim 36 where each said roller is solid.

38. The roller vane stage of claim 37 where said roller has a thickness and a diameter such that said thickness of said roller is no less than said diameter of said roller.

39. The roller vane stage of claim 38 where said thickness of said roller is twice said diameter of said roller.

40. The roller vane stage of claim 29 where said eccentric inner surface is defined by a first circular arc having a radius and by a second circular arc having a radius, said second circular arc being oppositely disposed of said first circular arc, said first and second arcs being interconnected by a plurality of circular arcs of differing radii, said first arc radius being greater than said second arc radius and each of said radii of said plurality of circular arcs, said second arc radius being smaller than said first arc radius and each of said radii of said plurality of circular arcs;

wherein said bisected circular arc is said second circular arc.

41. The roller vane stage of claim 40 where said rotor has a driver slot adapted to be engaged by a driver tang of a motor of the fuel pump to rotate said rotor within said rotor space so as to pump fuel, said rotor having a predetermined thickness, said driver slot having a depth less than said rotor thickness such that said driver slot does not extend completely through said rotor.

42. The roller vane stage of claim 29, wherein said rotor is mounted on a bearing, said bearing having a cap such that an armature of a motor of said fuel pump cannot extend completely therethrough.

43. A fuel pump including a roller vane stage, an inlet for receiving fuel, an outlet for exhausting fuel, and a motor for drivingly engaging said roller vane stage, said roller vane stage comprising:

an inlet plate, an outlet plate, and a spacer positioned therebetween, said spacer having an eccentric inner surface defining a rotor space therein, said inlet plate having at least one inlet port therethrough communicating with said rotor space, and said outlet plate having at least one outlet port therethrough communicating with said rotor space;

a rotor mounted for rotation within said rotor space and having a plurality of lobes spaced circumferentially about said rotor and opening radially outwardly towards said eccentric inner surface, a roller associated with and movable within each said lobe, said rotor further having a driver slot adapted to be engaged by a driver tang of a motor of said fuel pump to rotate said rotor within said rotor space so as to pump fuel, said rotor having a predetermined thickness, said driver slot having a depth less than said rotor thickness such that said driver slot does not extend completely through said rotor.

44. The fuel pump of claim 43 where said inlet plate has first and second inlet ports and said outlet plate has first and second outlet ports.

45. The fuel pump of claim 44 where said second inlet port is spaced radially outwardly of said first inlet port and said second outlet port is spaced radially outwardly of said first outlet port.

46. The fuel pump of claim 45 where said first and second inlet ports are arcuate in shape, said second outlet port is arcuate in shape, and said first outlet port is defined by a U-shaped section and an arcuate section intersecting the otherwise open end of said U-shaped section.

47. The fuel pump of claim 46 where said first inlet port and said first outlet port are positioned to form a first pair of cooperating ports, and said second inlet port and said second outlet port are positioned to form a second pair of cooperating ports.

48. The fuel pump of claim 47 where said first inlet port has a trailing edge and a tapered extension disposed ahead of said trailing edge.

49. The fuel pump of claim 43 where said rotor has five lobes.

50. The fuel pump of claim 49 where each said lobe is U-shaped and each roller is cylindrical and sized to fit within said U-shaped lobe.

51. The fuel pump of claim 50 where each said roller is solid.

52. The fuel pump of claim 51 where said roller has a thickness and a diameter such that said thickness of said roller is no less than said diameter of said roller.

53. The fuel pump of claim 52 where said thickness of said roller is twice said diameter of said roller.

54. The fuel pump of claim 43 where said rotor has two driver slots adapted to be engaged by a pair of driver tangs of said fuel pump motor.

55. The fuel pump of claim 43 where said eccentric inner surface is defined by a first circular arc having a radius and by a second circular arc having a radius, said second circular arc being oppositely disposed of said first circular arc, said first and second arcs being interconnected by a plurality of circular arcs of differing radii, said first arc radius being greater than said second arc radius and each of said radii of said plurality of circular arcs, said second arc radius being smaller than said first arc radius and each of said radii of said plurality of circular arcs.

56. The fuel pump of claim 55 where each said roller has a diameter, said rotor also having a radius, the difference between said radius of said first arc and said radius of said rotor being no greater than one-half the diameter of said rollers.

57. The fuel pump of claim 56 where said second circular arc of said eccentric inner surface is bisected by a reference line intersecting the axis of said rotor, and said outlet port is sized such that as said rotor rotates, one of said lobes will be in fluid communication with said outlet port until said one lobe becomes tangent to the reference line.

58. The fuel pump of claim 42 where said eccentric inner surface has a circular arc bisected by a reference line intersecting the axis of said rotor, and said outlet port is sized such that as said rotor rotates, one of said lobes will be in fluid communication with said outlet port until said one lobe becomes tangent to the reference line.

59. The roller vane stage of claim 42, wherein said rotor is mounted on a bearing, said bearing having a cap such that an armature of said motor of said fuel pump cannot extend completely therethrough.

60. A roller vane stage for a fuel pump comprising:

an inlet plate, an outlet plate, and a spacer positioned therebetween, said spacer having an eccentric inner surface defining a rotor space therein, said inlet plate having at least one inlet port therethrough communicating with said rotor space, and said outlet plate having at least one outlet port therethrough communicating with said rotor space;

a rotor mounted for rotation within said rotor space and having a plurality of U-shaped lobes spaced circumferentially about said rotor and opening radially outwardly towards said eccentric inner surface, said rotor further having a driver slot adapted to be engaged by a driver tang of a motor of the fuel pump to rotate said rotor within said rotor space so as to pump fuel, said rotor having a predetermined thickness, said driver slot having a depth less than said rotor thickness such that said driver slot does not extend completely through said rotor; and a cylindrical roller associated with and movable within each said U-shaped lobe, said roller has a thickness and a diameter such that said thickness of said roller is not less than said diameter of said roller.

61. The roller vane stage of claim 60 where each said roller is solid.

62. The roller vane stage of claim 60 where said thickness of said roller is twice said diameter of said roller.

63. A fuel pump including a roller vane stage, an inlet for receiving fuel, an outlet for exhausting fuel, and a motor for drivingly engaging said roller vane stage, said roller vane stage comprising:

an inlet plate, an outlet plate, and a spacer positioned therebetween, said spacer having an eccentric inner surface defining a rotor space therein, said inlet plate having at least one inlet port therethrough communicating with said rotor space, and said outlet plate having at least one outlet port therethrough communicating with said rotor space;

a rotor mounted for rotation within said rotor space and having a plurality of U-shaped lobes spaced circumferentially about said rotor and opening radially outwardly towards said eccentric inner surface, said rotor further having a driver slot adapted to be engaged by a driver tang of a motor of the fuel pump to rotate said rotor within said rotor space so as to pump fuel, said rotor having a predetermined thickness, said driver slot having a depth less than said rotor thickness such that said driver slot does not extend completely through said rotor; and a cylindrical roller associated with and movable within each said U-shaped lobe, said roller has a thickness and a diameter such that said thickness of said roller is not less than said diameter of said roller.

64. The roller vane stage of claim 63 where each said roller is solid.

65. The roller vane stage of claim 63 where said thickness of said roller is twice said diameter of said roller.

* * * * *

UNITED STATES PATENT AND TRADEMARK OFFICE

CERTIFICATE OF CORRECTION

PATENT NO. : 6,099,261

DATED : August 8, 2000

INVENTOR(S) : Gary Worden

It is certified that errors appear in the above-identified patent and that said Letters Patent is hereby corrected as shown below:

In column 7, line 66, please delete "to 10 pump" and replace with --to pump--;

In column 14, line 54 (claim 58, line 1), please delete "claim 42" and replace with --claim 43--;

In column 14, line 60 (claim 59, line 1), please delete "claim 42" and replace with --claim 43--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*